US012329200B2

(12) United States Patent
Zominy et al.

(10) Patent No.: US 12,329,200 B2
(45) Date of Patent: Jun. 17, 2025

(54) VAPOUR GENERATING DEVICE

(71) Applicant: JT International S.A., Geneva (CH)

(72) Inventors: Claude Zominy, Copponex (FR); Pingkun Liu, Guangdong (CN); Yongbao Yuan, Guangdong (CN); Juan José Moreno Rodríguez, Geneva (CH)

(73) Assignee: JT International S.A. (CH)

( * ) Notice: Subject to any disclaimer, the term of this patent is extended or adjusted under 35 U.S.C. 154(b) by 1109 days.

(21) Appl. No.: 17/282,238

(22) PCT Filed: Oct. 3, 2019

(86) PCT No.: PCT/EP2019/076843
§ 371 (c)(1),
(2) Date: Apr. 1, 2021

(87) PCT Pub. No.: WO2020/070259
PCT Pub. Date: Apr. 9, 2020

(65) Prior Publication Data

US 2021/0345672 A1 Nov. 11, 2021

(30) Foreign Application Priority Data

| | | |
|---|---|---|
| Oct. 3, 2018 | (EP) | 18198485 |
| Dec. 11, 2018 | (EP) | 18211725 |
| Jun. 26, 2019 | (GB) | 1909203 |

(51) Int. Cl.
*A24F 40/46* (2020.01)
*A24F 40/20* (2020.01)
(Continued)

(52) U.S. Cl.
CPC ..... *A24F 40/46* (2020.01); *A24F 40/20* (2020.01); *A24F 40/48* (2020.01); *A24F 40/53* (2020.01); *A24F 40/60* (2020.01)

(58) Field of Classification Search
CPC ..... A24F 40/46; A24F 40/20; A24F 40/48; A24F 40/53; A24F 40/60; A24F 40/485; A24F 40/40; A24F 40/50; A24F 40/51
See application file for complete search history.

(56) References Cited

U.S. PATENT DOCUMENTS 5,954,979 A * 9/1999 Counts ..... A24F 40/485 131/194
2005/0016550 A1* 1/2005 Katase ..... A24F 40/50 131/194

(Continued)

FOREIGN PATENT DOCUMENTS

CN 107095344 A 8/2017
CN 207011682 U 2/2018

(Continued)

OTHER PUBLICATIONS

International Search Report for PCT/EP2019/076843 mailed Jan. 30, 2020; 4 pages.

*Primary Examiner* — Travis S Chambers
(74) *Attorney, Agent, or Firm* — Lerner David LLP

(57) ABSTRACT

A heating assembly for a vapour generating device includes: a heating chamber arranged to hold an aerosol generating medium; a heater arranged, in use, to provide heating to the heating chamber; and an ejector arranged to controllably eject, in use, the aerosol generating medium from the heating chamber. A vapour generating device includes the heating assembly; and a vapour passage to carry vapour generated in the heating chamber from the heating chamber to an air outlet, wherein at least a portion of the vapour passage is formed by the ejector.

14 Claims, 7 Drawing Sheets

(51) Int. Cl.

| | |
|---|---|
| ***A24F 40/48*** | (2020.01) |
| ***A24F 40/53*** | (2020.01) |
| ***A24F 40/60*** | (2020.01) |

(56) References Cited

U.S. PATENT DOCUMENTS

| | | | | |
|---|---|---|---|---|
| 2011/0290269 | A1 | 12/2011 | Shimizu | |
| 2014/0353185 | A1* | 12/2014 | Liu | A24F 15/01 206/249 |
| 2015/0013696 | A1 | 1/2015 | Plojoux et al. | |
| 2017/0042251 | A1 | 2/2017 | Yamada et al. | |
| 2017/0172215 | A1 | 6/2017 | Li et al. | |
| 2018/0049472 | A1 | 2/2018 | Mahler et al. | |
| 2019/0208823 | A1* | 7/2019 | Raichman | A61P 43/00 |
| 2019/0274358 | A1* | 9/2019 | Reevell | A24F 7/00 |
| 2023/0371591 | A1* | 11/2023 | Lyell | A24F 40/40 |

FOREIGN PATENT DOCUMENTS

| | | | | |
|---|---|---|---|---|
| CN | 207054784 | U | 3/2018 | |
| CN | 108354230 | A | 8/2018 | |
| EP | 3167728 | A1 * | 5/2017 | A24F 40/30 |
| JP | 2014-533513 | A | 12/2014 | |
| JP | 2017-163974 | A | 9/2017 | |
| JP | 2017-192393 | A | 10/2017 | |
| JP | 2018-504134 | A | 2/2018 | |
| WO | 2010/090338 | A1 | 8/2010 | |
| WO | WO-2013076098 | A2 * | 5/2013 | A24B 15/167 |
| WO | 2015198015 | A1 | 12/2015 | |
| WO | 2016124550 | A1 | 8/2016 | |
| WO | 2017194763 | A2 | 11/2017 | |
| WO | WO-2018050610 | A1 * | 3/2018 | A24B 15/167 |
| WO | 2018/120206 | A1 | 7/2018 | |

* cited by examiner

VAPOUR GENERATING DEVICE

CROSS-REFERENCE TO RELATED APPLICATIONS

The present application is a national phase entry under 35 U.S.C. § 371 of International Application No. PCT/EP2019/076843, filed Oct. 3, 2019, published in English, which claims priority to European Application No. 18198485.7 filed Oct. 3, 2018, European Application No. 18211725.9 filed Dec. 11, 2018, and Great Britain Application No. 1909203.0 filed Jun. 26, 2019, the disclosures of which are incorporated herein by reference.

BACKGROUND OF INVENTION

The present invention relates to a heating assembly for a vapour generating device. Devices which heat, rather than burn, a substance to produce a vapour for inhalation have become popular with consumers in recent years.

Such devices can use one of a number of different approaches to provide heat to a substance to produce a vapour. One such approach is a vapour generating device which provides heat to a removable body containing aerosol-generating material. In such a device, proximity of the heat source to the body is usually desirable in order to maximise heat energy transferred from the heat source of the device to the aerosol-generating material. Ideally, the removable body is in contact with the heat source to maximise efficiency of heat transfer. However, in practice, this can make the removal of a depleted body difficult as the depleted aerosol-generating material may stick to the heat source, and/or its movement may be restricted due to friction. Furthermore, one or more of the heat source and the aerosol-generating material can often retain substantial heat after use, which presents a risk of scalding the user when attempting to remove the depleted body.

Attempts have been made to reduce the negative impact of this problem by providing devices using removable bodies having a double wall system: one wall for the heat source and one to contain the aerosol generating material. However, due to the increased distance between the heat source and the aerosol-generating material, such a solution can result in poor heat transfer capability and increased heating times in some cases, and can increase the cost of a consumable including the aerosol-generating material.

Furthermore, there is a growing demand for devices which allow users to promptly replace depleted aerosol-generating material so as to ensure freshness and the production of high quality vapour. However, it can often be difficult for consumers to define when their current aerosol-generating material is depleted and must be changed. One solution is to implement a puff counter, which helps to inform the user of the extent to which the aerosol-generating material has been used. However, such puff counters often do not have the capability to detect the insertion of a new body of aerosol generating material.

The present invention seeks to address at least one of the above problems.

SUMMARY OF INVENTION

According to a first aspect there is provided a heating assembly for a vapour generating device, the heating assembly comprising: a heating chamber arranged to hold an aerosol generating medium; a heater arranged, in use, to provide heating to the heating chamber; and an ejector arranged to controllably eject, in use, the aerosol generating medium from the heating chamber.

With the heating assembly according to the first aspect, when a user of the device wishes to remove the aerosol generating medium in use, he can simply actuate the ejector to eject the aerosol generating medium from the heating chamber of the device. This allows for quick and easy removal of the aerosol generating medium without the user having to engage excessively with the device. The use of the ejector further avoids the risk of the user having to come in to proximity with any heated elements. This allows the aerosol generating medium to be placed in close proximity to or in contact with the heating chamber surface whilst mitigating some of the problems identified above.

The aerosol generating medium may be provided in one or more of a number of different forms. The aerosol generating medium may be a capsule which comprises an aerosol generating substance inside an air permeable material. Any material enclosing the aerosol generating substance may have a high air permeability to allow air to flow through the material with a resistance to high temperatures. Examples of suitable air permeable materials include cellulose fibres, paper, cotton and silk. The air permeable material may also act as a filter. Alternatively, the aerosol generating medium may be an aerosol generating substance wrapped in paper.

Alternatively, the medium may be an aerosol generating material held inside a material that is not air permeable, but which comprises appropriate perforation or opening to allow air flow. Alternatively, the medium may be a body of the aerosol generating substance itself. Preferably, the body is a mousse or a foam of the aerosol generating substance. Alternatively, the medium may be formed substantially in the shape of a stick which may have a mouthpiece filter. In such a case, the medium may be a sheet such as a paper wrapped aerosol generating material.

Preferably, the aerosol generating medium may be a body comprising an aerosol generating substance. The aerosol generating substance may be any suitable substance capable of forming an aerosol. Preferably the aerosol generating substance is capable of forming an aerosol when heated. The substance may be a solid or semi-solid substance. Typically, the substance may comprise plant derived material, and in particular, the substance may comprise tobacco. Example types of aerosol generating solids include powder, granules, pellets, strands, porous material, foam or sheets. Alternatively, the aerosol generating medium may comprise a cartridge or a capsule containing solid, semi-solid or liquid substance.

Preferably, the aerosol generating substance may comprise an aerosol-former. Examples of aerosol-formers include polyhydric alcohols and mixtures thereof such as glycerine or propylene glycol. When comprising an aerosol-former, typically the aerosol generating substance may comprise an aerosol-former content of between approximately 5% and approximately 50% on a dry weight basis. Preferably, the aerosol generating substance may comprise an aerosol-former content of approximately 15% on a dry weight basis.

Typically, the body comprises humectant or tobacco containing moisture. Preferably, the body comprises one or more of humectant, tobacco, glycerine and propylene glycol. Typically, the body may comprise a percentage of vaporisable or aerosolisable liquid (preferably of humectant such as propylene glycol and/or glycerine, but possibly additionally including other aerosolisable liquids such as water or ethanol, etc.) which is greater than 20 wt %. In this context, 100 wt % is equal to the total weight of the liquid and the vaporisable or aerosolisable substance, such as tobacco, humectant and/or plant derived material.

Aspects of the present invention are particularly useful when, for example, the aerosol generating medium comprises a body of a foam of tobacco. Typically, the body may comprise between approximately 40 wt % and 70 wt % humectant. Such a body can contain significant moisture, which can make the body difficult to remove by hand from the heating chamber of a vapour generating device, due to the body sticking to the walls of the heating chamber. Aspects of the present invention allow such bodies to be easily removed from the device by actuation of the ejector.

The heating assembly may further comprise a detector arranged, in use, to detect actuation of the ejector. The detector may be connected to other components in the device to activate certain functions in the device. For example, the detector may be arranged to send a signal to a control module in response to the detection of actuation of the ejector. Such an arrangement allows the device to perform various actions based on the status or actuation of the detector. For example, particular functions of the device may be arranged to depend on the status or actuation of the detector.

One preferred function of the arrangement of detector sending a control signal to the control module upon detecting actuation of the ejector may be to control the number of refills that a user can make. This can be advantageous from a safety perspective to discourage the user from inserting inappropriate substances into the device. For example, the control module may be arranged to read information from a packet of appropriate portions of aerosol generating medium, and based on that information to determine an expected number of times for the user to perform an ejection in order to consume the entire number of portions associated with the (read) packet. This can then form the basis for controlling the device to permit only a corresponding number of ejections to be made by the device before a warning may be issued that the user needs to purchase a new packet of portions, and possibly to take additional actions such as preventing further operation of the device (in terms of heating up the heating chamber sufficiently to generate vapour from an appropriate portion of aerosol generating medium) until a new packet has been read by the device.

The vapour generating device may be equipped with a puff counter. The puff counter may typically be implemented to detect when a user inhales, or 'takes a puff of', vapour generated by the device. Such an implementation may be achieved for example by using sensors arranged to detect the inhalation of air from the device, or by using sensors arranged to detect the use of the heater. Information from the puff counter may be used to activate certain functions in the device, and may also be used to provide useful information to the user, for example via a puff indicator or puff count indicator.

One useful function of the puff counter is that a user can be informed of the number of puffs taken from a particular body of aerosol generating medium in the chamber. When a body of aerosol generating medium is ejected by the ejector, an existing puff count may be reset. Typically, the control module may be arranged to reset a puff counter in the vapour generating device in response to the detection of actuation of the ejector. Such an arrangement allows the puff counter to be easily kept up to date with the usage of the aerosol generating material held within the device without the need for additional detection mechanisms, resulting in a lightweight and simple vapour system which allows the user to keep track of the state of the aerosol generating material contained therein.

Actuation of the ejector may be detected by the detector through one of a number of approaches. The detector may be arranged to detect the position or orientation of the ejector, in order to determine when the ejector has been actuated. The ejector may comprise one or more electrical contacts, and the detector may be arranged, in use, to detect actuation of the ejector based on the position of the one or more electrical contacts. For example, in a simple implementation, the detector may comprise one or more open circuits, and the actuation of the ejector may place the electrical contacts of the ejector in a position or orientation so as to complete one or more of the open circuits in the detector. Such an arrangement provides a simple, robust and reliable detector for detecting actuation of the ejector.

Whilst the ejector may take any shape and size, typically, the ejector comprises a tubular portion. The tubular portion may typically be arranged to have a longitudinal axis parallel to a longitudinal axis of the vapour generating device, and may be used to provide extension from the source of an ejecting force. The one or more electrical contacts may be positioned on the tubular portion of the ejector. Such an arrangement allows an efficient use of space, resulting in a simple device structure. The tubular portion may form an aerosol passage as described below.

Typically, the heating chamber comprises an opening, and the ejector is arranged to push, in use, the aerosol generating medium toward the opening of the chamber. The opening may be permanently exposed. Alternatively, the opening may be covered by a removable or retractable cover.

According to another aspect there is provided a vapour generating device comprising a heating assembly according to any of the above aspects. By using a heating assembly having ejection capabilities, it is possible to provide an efficient vapour generating device which allows the user to easily remove and replace aerosol-generating material, and which can quickly and reliably provide high quality vapour.

The vapour generating device may comprise an air inlet arranged to provide air to the heating chamber. The vapour generating device may further comprise a vapour passage to carry vapour generated in the heating chamber from the heating chamber to an air outlet. At least a portion of the vapour passage may be formed by the ejector. This allows the provision of a compact design. In use, ambient air may enter the heating chamber of the heating assembly through the air inlet. Vapour produced by the transfer of heat from the heater to the aerosol-generating medium may then be carried by the air in the heating chamber. The air may then be drawn out from the heating chamber through the air outlet to a user's mouth for inhalation. The device may be provided with a mouthpiece in communication with the air outlet, to facilitate the inhalation by a user of vapour generated by the device.

According to another aspect there is provided a vapour generating device comprising the heating assembly according to any of the above aspects; and an air passage to carry air from an air inlet to the heating chamber, wherein at least a portion of the air passage is formed by the ejector. The device may further comprise a vapour passage to carry vapour generated in the heating chamber from the heating chamber to an air outlet, wherein at least a portion of the vapour passage is formed by the ejector.

Whilst the ejector forms a portion of the air passage, when actuated the ejector may typically need to move with respect to the rest of the air passage. The air passage may comprise a gasket, and the ejector may be sealed within the passage by the gasket when the device is operable to generate vapour. The gasket may be employed to ensure a fluid tight seal within the passage, typically between the ejector and other components of the passage, to allow a smooth and controlled flow of air and vapour through the device.

Typically, the ejector may be arranged to eject the aerosol generating medium toward the outlet of the device. Such an arrangement may generally result in the alignment in the direction of motion of the aerosol generating medium, when ejected, with the direction of air and vapour flow through the device.

The device may further comprise a switch operable to actuate the ejector. Typically, the switch may comprise a sliding lever mechanism comprising a slide handle connected to a lever through a pivot, and the lever may be connected to the ejector such that movement of the slide handle causes movement of the ejector. Actuation of the ejector may cause the ejector to move in the direction of air flow through the device. Alternatively, or in combination, a switch may comprise an electro-mechanical system arranged to actuate the ejector. Such an electro-mechanical system may comprise for example a motor to provide motorised actuation of the ejector and/or other components of the device.

The ejector may effect ejection of the aerosol generating medium in one of a number of manners. The ejector may apply a force on the aerosol generating medium to accelerate the aerosol generating medium out of the heating chamber. The force may be exerted by a surface of the ejector. Typically, the ejector may comprise a protrusion arranged, in use, to apply a force on the aerosol generating medium. This allows the force applied by the ejector on the aerosol generating medium to be consistent with each actuation. The protrusion may have substantially the same cross sectional shape and size as the cross sectional shape and size of the heating chamber. Such an arrangement ensures that the ejector is able to eject all of the aerosol generating medium inside the chamber when actuated.

Whilst the protrusion may take any shape and size, typically, the protrusion may comprise two main surfaces. The protrusion may comprise a contact surface arranged, in use, to come into contact with the aerosol generating medium, and a passive surface. The contact surface of the protrusion may be the point of contact between the ejector and the aerosol-generating medium, at which a force from the ejector is applied to the aerosol generating medium to accelerate the aerosol generating medium out of the chamber. The passive surface of the protrusion may be opposite to the contact surface. The passive surface may define a space in the vapour generating device, the space forming part of the vapour passage. An air flow path may place the contact surface and the passive surface in fluid communication. Such an arrangement allows the vapour generated in the heating chamber to be effectively communicated to the user.

Typically, the protrusion may be connected to the tubular portion of the ejector. The tubular portion may form a vapour passage which is communicated to the space defined by the passive surface. Such an arrangement allows the vapour generated in the heating chamber to be more effectively communicated to the user, whilst providing a simple structure.

The air flow path of the protrusion may place the contact surface in fluid communication with both the space and the vapour passage of the tubular portion.

Whilst the heating chamber may be fixed to the heating assembly, typically, the heating chamber may be a removable chamber. Removal of the heating chamber allows the chamber to be easily cleaned and maintained, and allows the part to be replaced if necessary. The heating chamber may be manually removed by the user. Alternatively, the ejector may be configurable to also eject, in use, the removable chamber. As the ejector is better able to apply force to remove the heating chamber, this allows the heating chamber to be better secured in the heating assembly further improving performance of the device.

In such a case, the ejector has the capability to eject both the aerosol generating medium and the heating assembly. The user may choose which of the components is to be ejected, before actuating the ejector. This may be achieved by the provision of a switch, or by the provision of an ejector whose action is affected by its position or orientation. The ejector may be configurable to a first and a second position, arranged such that a user can, in use, select the subject to be ejected based on the position of the ejector. For example, the ejector in a first position may be arranged, in use, to eject the aerosol generating medium and the ejector in a second position may be arranged, in use, to eject the heating chamber. Such an arrangement provides the user with flexibility and significantly improved ease of use. By taking advantage of the position or orientation of the ejector as a mechanism for selecting which component is to be expelled from the heating assembly, the device can be efficiently and compactly designed while providing the useful functionality of a removable heating chamber.

In practice, the vapour generating device may typically be loaded with a consumable, such as an aerosol generating medium, which may be heated by the device to produce an aerosol or vapour inhaled by the user. As noted above, various different aerosol generating consumables may provide different inhalation experiences to the user when used with the device. The variation in inhalation experience may include for example differences in flavour, nicotine content, smoke profile and combinations thereof. Each type of consumable may be associated with data specific to its type, such as recommended heating profile, recommended maximum number of puffs, and estimated expiry time.

In addition, consumables may be sold in packets containing multiple consumables (e.g. in the form of portions of mousse). The data relating to the consumable may be provided for example on the packaging of the consumable. The data may be provided via text, Quick-Response (QR) code, RFID tags and/or other communication means.

The vapour generating device may comprise a communication unit arranged to provide communication of parameters related to operation of the device. Such parameters may include data relating to a consumable to be used with the device. The communication unit may comprise an interface to allow a user to manually input, for example, specific data relating to a consumable. Alternatively, or in combination, the communication unit may employ one or more of a number of communication methods to receive or transmit parameters. These may include for example WiFi standards, Bluetooth communication, RFID communication, Quick-Response (QR) code communication and character recognition techniques. The communication unit may communicate via an intermediary device such as a smartphone, which in turn may have means for scanning a package containing appropriate consumable items. For example, a smartphone may include an "app" (or something similar such as a Progressive Web Application (PWA)) by which it may read an indicia (e.g. a QR code) printed on the package or an RFID tag embedded in the package and may then communicate this information, or information derived therefrom to the device (e.g. via a short range communication protocol such as Bluetooth, etc.).

By having such a communication unit it is possible for the user to easily input data related to a consumable he wishes to use with the device. The data may be stored on a memory storage on the device, which may be integral with the control module or separately provided. The device may then operate according to the inputted data. For example, the heater may automatically adjust its heating time and temperature according to an inputted recommended heating profile of the consumable. The heater may also be arranged to limit or stop its operation according to a number of puffs counted by the puff counter and an inputted maximum recommended number of puffs with the consumable.

In one example device, the ejector may be arranged to eject the consumable when the consumable is deemed to be fully used or expired. For example, the ejector may be arranged to automatically eject the consumable when the puff counter reaches a maximum recommended number of puffs with the consumable, or if an estimated expiry time of the consumable is deemed to be reached. Such controlled operation of the device may be effected by the control module, or by a separate processor on-board the device.

With such tailored operation capabilities, it is possible to provide optimum control of the vapour generating device to ensure safe and reliable vapour generation, whilst providing an improved quality of vapour generation with each consumable.

Additionally, as a safety measure, the device may restrict the number of times that a user can use the device to generate aerosol based (at least in part) on the number of times that the ejector has been activated (hereinafter also referred to as ejection events); preferably in addition to information about the number of detected ejection events, the restriction of the number of times that a user can use the device to generate aerosol may also be based on the total duration of heating between detected ejection events, etc. For example, if data read from a package of appropriate consumable items indicates that it contains X consumable items, then after, say, X+Y ejection events have been detected (where Y is a number such as 2 to account for erroneous ejection events) the user may be informed that further use of the device requires reading a new package of appropriate consumables. Then, in some embodiments, after providing such a notification to the user, further use of the device to generate aerosol may be prevented until a fresh package of appropriate consumables has been read via the communication unit.

Information about the duration of heating between ejection events may also be used to prevent counting "extra" ejection events—e.g. where a user needs to use multiple ejection activations to completely remove the consumed consumable, these would only count as a single ejection event in certain embodiments. Similarly, if a user ejects one consumable portion before it has been completely depleted of aerosol forming substrate (e,g, in order to replace it with a different consumable (e.g. having a different flavour) and then wishes to re-insert the partially depleted consumable) then such intermediate ejections might also not be counted as ejection events in certain embodiments.

The vapour generating devices of the various aspects disclosed above may of course use any combination of features of any of the other aspects as set out above and apply these features to one or more of the corresponding components, to provide similar advantages.

BRIEF DESCRIPTION OF THE DRAWINGS

An example vapour generating device and heating assembly will now be described by way of example with reference to the accompanying drawings, in which.

DETAILED DESCRIPTION

Figure 1:
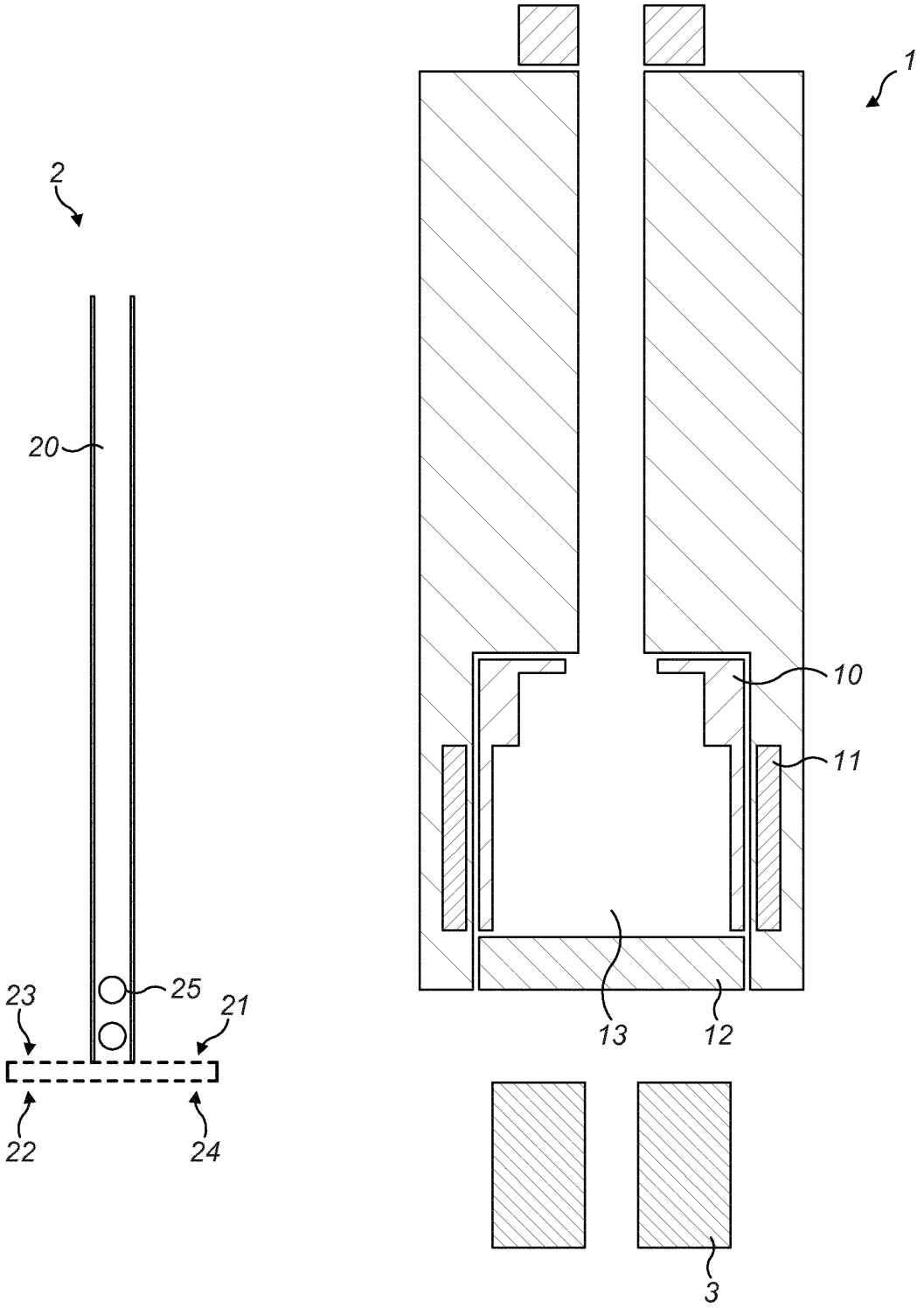
FIG. 1 schematically illustrates an example vapour generating device in a generally unassembled configuration.

An example vapour generating device is generally illustrated in an unassembled configuration in FIG. 1. The vapour generating device comprises a heating assembly 1 and an ejector 2.

The vapour generating device is arranged to heat a body of aerosol generating medium 3 to produce a vapour to be inhaled by a user. In this example, the body 3 comprises a tubular, semi-solid mousse of tobacco material. The semi-solid mousse comprises tobacco foam. Tobacco foam typically comprises a plurality of fine tobacco particles and can typically also comprise a volume of water and/or a moisture additive, such as a humectant. The tobacco foam may be porous, and may allow a flow of air or vapour through the foam. Although the examples below will be described with reference to a tobacco body 3, it will be understood that the body 3 can alternatively comprise other suitable substances and structures comprising an aerosol generating material or substance.

The heating assembly 1 comprises a heating chamber 10 arranged to receive a body of aerosol generating medium 3. In this example, the heating assembly 1 is generally cylindrical in shape, and the aerosol generating medium 3 is cylindrical, or tubular. The heating chamber 10 is shaped and arranged to tightly receive the body 3 of aerosol generating medium. By 'tightly' in this context we intend to mean that the dimensions (depth, diameter, height etc.) of the heating chamber 10 approximately match those of the body 3.

A heater 11 is provided in the heating assembly 1 and is arranged, in use, to provide heating to the chamber 10. In this example, the heater 11 is a resistive heater, which heats up by the Joule effect when current is passed through. In other examples the heater 11 can have different mechanisms of providing heat to the heating chamber—for example, by induction heating. Although not shown in the figures, the heater 11 is typically connected to an electrical power source, such as a rechargeable battery. The heater 11 in this example is arranged to provide heat towards the central portion of the heating chamber 10. In other words, the heat generated by the heater 11 is generally directed inwards toward the central longitudinal axis of the heating chamber 10. This can be achieved for example by providing heat insulation on an outer, circumferential surface of the heater 11.

The heating chamber 10 and the heater 11 are arranged such that, when a body 3 of aerosol generating medium is inserted and held in the chamber 10 in use, the body 3 is in close proximity to an inner wall of the heating chamber 10. Preferably, the body 3 is arranged, in use, in contact with the inner wall of the heating chamber 10. This ensures that the distance between the heater 11 and the body 3 is minimised so as to provide maximal heat transfer from the heater 11 to the body 3.

The chamber 10 comprises an opening 13, which in this example is covered by a lid 12 having at least one aperture. In use, the aperture of the lid 12 acts as an air inlet to allow ambient air to enter the chamber. The lid 12 is retractable to reveal the opening. In use, the body 3 of aerosol generating material to be vaporised can be inserted to the heating assembly 1 by the user through the opening 13. The lid 12 ensures that the body 3 is securely held in place by the heating chamber 10. Furthermore, the lid 12 encloses the heating chamber 10 such that, in use, heat from the heater 11 is better contained within the chamber 10. The retraction of the lid 12 can be operated manually by a user. Alternatively, the lid 12 can be opened and closed in connection with other functions (described below) of the device. The lid 12 in this example comprises a hinge mechanism. Whilst the opening 13 in FIG. 1 is illustrated at a distal end (bottom end in the figure), in other examples the opening 13 is positioned at a proximal end (top end in the figure) of the device.

The ejector 2 is generally elongate, as shown in FIG. 1, and comprises a tubular portion 20 and a protrusion 21. In this example the ejector 2 is generally piston-shaped. The tubular portion 20 in this example is hollow, meaning that its cross section has an aperture extending therethrough. The hollow central axis of the tubular portion 20 forms part of a vapour passage, which can be accessed to provide fluid communication through the openings 25 on the tubular portion 20. The vapour passage provides a path for the vapour generated in the heating chamber to flow, to provide the vapour to the user when the user takes a puff on the device.

Whilst the aerosol generating medium will typically produce a gas or a solid and/or liquid suspension in gas when heated, it will be appreciated that the terms 'vapour' and 'aerosol' are used interchangeably here, and refer generally to the substance which is produced when the aerosol generated medium is heated.

The protrusion 21 is positioned at one extremal end of the tubular portion 20, and comprises a flat circular shape. The cross sectional profile of the protrusion 21 matches that of the heating chamber 10. In other words, when positioned within the heating assembly 1 in use, the circumferential edge of the protrusion is in close proximity to, or is in fact in contact with, the inner wall of the heating chamber 10. The protrusion 21 in this example comprises two main surfaces. A passive surface 23 is positioned at the side of the protrusion 21 which is connected to the tubular portion 20. On the reverse side of the protrusion there is a contact surface 22. In other words, the passive surface 23 and contact surface 22 are on opposing faces of the protrusion 21. In other examples, the protrusion 21 can take other forms, such as conical or cross-shaped.

The protrusion 21 comprises one or more apertures 24, each forming an air flow path. The air flow paths formed by the apertures 24 place the contact surface 22 in fluid communication with the passive surface 23.

Figure 2A:
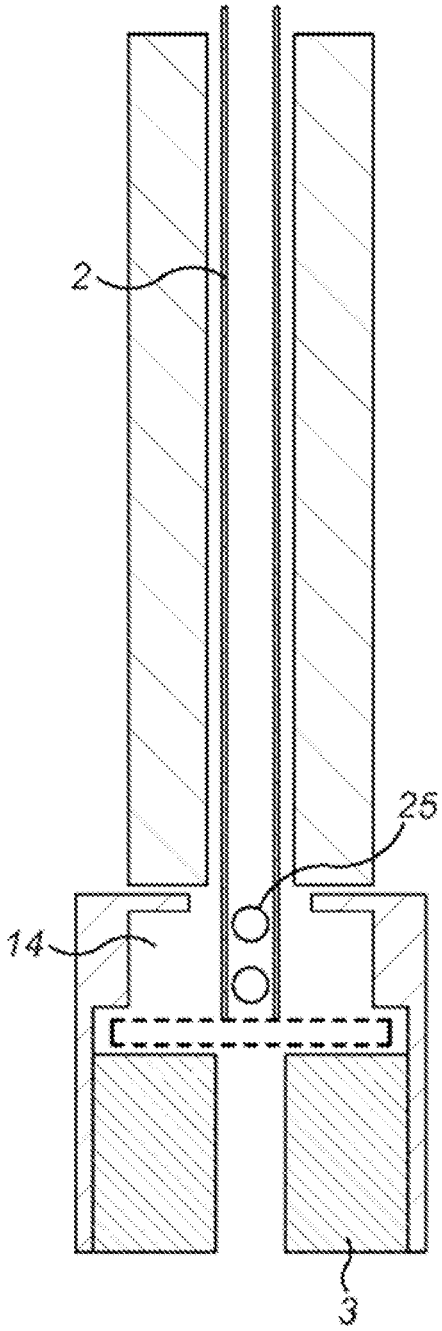
FIG. 2A schematically illustrates a close-up view of an example vapour generating device in a first assembled configuration.

In use, the contact surface 22 is arranged to come into contact with the tobacco body 3 to exert a force on at least a portion of the tobacco body 3. FIG. 2A generally illustrates a section of the example vapour generating device in an assembled configuration. The ejector 2 is positioned within the heating assembly 1 such that the protrusion 21 extends into the heating chamber 10. The device is shown in a configuration in which the ejector 2 is in a retracted, non-actuated position. This configuration illustrates for example the arrangement of components when the device is in use and the user is operating the device to generate and inhale vapour generated in the heating chamber 10.

In this configuration, the heating chamber 10 is substantially occupied by the tobacco body 3 and the protrusion 21 of the ejector 2 is positioned at an extremal end of the heating assembly 10. The contact surface 22 of the protrusion 21 is proximal to or in contact with a surface of the tobacco body 3, but the contact surface 22 does not exert any substantial force on the body 3. A space 14 is defined between the passive surface 23 and interior walls of the heating assembly 1.

When the user activates the heater 11, either by manually switching the heater on or by performing an action which triggers the operation of the heater, heat is provided to the heating chamber 10. The body 3 is heated and made to release to the heating chamber 10 a vapour comprising aerosolised particles of the aerosol generating substance—in this case tobacco. As the user inhales at a proximal end of the device, negative pressure created by the inhalation forces the vapour away from the heating chamber 10 towards the proximal end. In this example, a mouthpiece is provided at the proximal end located at the top of the device in FIG. 2A, resulting in a vapour flow away from the lid 12 and opening 13.

As described above, the apertures 24 of the protrusion 21 create an air flow path allowing the vapour to flow through to the space 14 between the ejector protrusion 21 and interior walls of the heating assembly 1. From the space 14, all, or a substantial portion of the vapour flows through the openings 25 on the tubular portion of the ejector 2 into the hollow central axis of the ejector 2. A portion of the vapour may also enter the hollow central axis of the ejector 2 directly through one or more apertures 24 of the protrusion 21. The negative pressure at the proximal end causes the vapour to flow through the ejector and out to a mouthpiece (not shown), where the vapour can be inhaled by the user. In some examples, a space between the interior walls of the device and the tubular portion 20 of the ejector 2 allows a portion of the vapour to flow to the user without entering the hollow central axis of the ejector 2. In this way, a useful and efficient heating and ejector mechanism can be provided in a vapour generating device whilst maintaining high quality air and vapour flow of such a device.

Figure 2B:
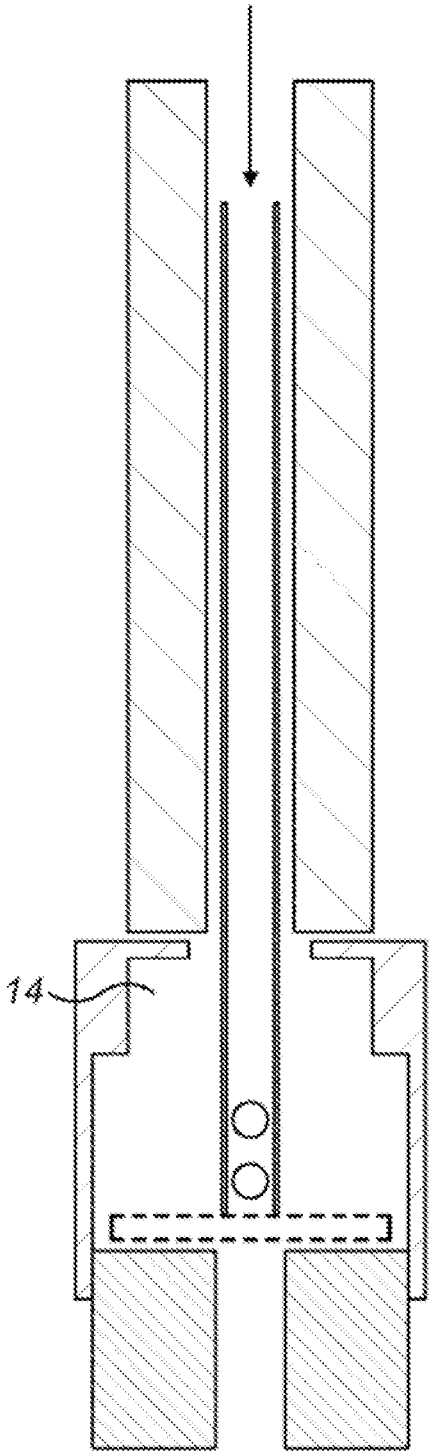
FIG. 2B schematically illustrates a close-up view of an example vapour generating device in a second assembled configuration.

In use, the ejector 2 can be actuated by a user to eject the tobacco body 3 from the heating chamber 10, as illustrated in FIG. 2B. In operation, the ejector 2 is advanced toward the body 3 (in the direction of the arrow in FIG. 2B) such that the contact surface 22 exerts a force on at least a portion of the body 3, causing the body 3 to accelerate towards the opening 13 of the heating chamber 10. As the ejector 2 advances, the protrusion 21 moves into the heating chamber 10 to displace the body 3 out through the opening 13. As the protrusion 21 has a cross sectional profile which matches that of the heating chamber 10, the entire body 3 of tobacco is pushed by the contact surface 22 of the protrusion as the ejector advances into the heating chamber 10. The ejector 2 continues to advance until the protrusion 21 reaches a distal end, at which point the heating chamber 10 is fully occupied by the ejector 2 and the body 3 is fully ejected from the heating chamber 10.

To allow the body 3 to be ejected from the chamber, the lid 12 can be opened to expose the opening 13. Typically, the lid 12 is arranged to open when the ejector is actuated so as to allow a smooth ejection of the body 3. Alternatively, the lid can be configured to remain closed until explicitly opened by the user, to prevent accidental ejection of the body 3 from the heating chamber 10. Alternatively, the lid 12 can be arranged to be opened by a bottom portion of the body 3 as it accelerates towards the opening 13.

In some examples, the ejector 2 can be actuated—i.e. operated to move from the configuration shown in FIG. 2A to the configuration shown in FIG. 2B—manually by a user. That is, the ejector 2 can be advanced toward the body 3 by a user applying a force on the ejector 2. For example, a user may remove the mouthpiece and push an exposed top tubular portion of ejector 2. Alternatively, the ejector 2 can be actuated by a switch having a mechanism to advance the ejector 2 toward the body 3. For example, the ejector can be configured with a spring-loaded switch. In such a case, the user can simply operate the switch to advance the ejector 2 to eject the body 3. In some examples, the ejector can comprise a lever mechanism, operable between at least a first, passive configuration and a second, actuated configuration. Such a lever mechanism can comprise a sliding lever toggle, which rotates about a pivot point to effect reversible operation of the ejector between the at least two lever configurations. By sliding the toggle between at least two positions, the user can easily control the status and actuation of the ejector. The switch can also comprise an electromechanical system, such as a motor, to assist or control actuation of the ejector 2.

The ejector 2 can also be arranged to eject the body 3 automatically. In some examples the body 3 can be ejected when the puff counter is deemed to reach a pre-determined value, such as a maximum recommended value, for the body 3 in the chamber 10. Such a pre-determined value can be input manually into the device, or communicated to the device through a communication module on-board the device. For example, the packaging of the vapour generating body 3 can include an RFID tag which includes relevant data such as maximum number of puffs and expiry date. The RFID tag can be scanned and read by an RFID module on the device, to input data relating to the body 3 into the device, and the control module can control various components of the device according to the data relating to the body 3. In some examples, the control module can be arranged to limit use of the device according to a pre-determined number of ejection events. For example, a user can purchase a pack of consumables, whose packaging comprises a means of communicating data to the device. The data on the packaging may comprise the pre-determined number of ejection events, which can correspond to the number of consumables in the pack. In use, the device can scan the packaging to determine the number of consumables in the pack, and store within its memory an expected number of ejections corresponding to that pack. In other examples, the data relating to the consumables is present on the consumables themselves. As the user consumes the consumables in the pack, the device can count the number of ejection events, which signifies the number of consumables being inserted and replaced in the device. Once the expected number of ejections has been reached, the control module can for example disable use of the heater and/or display a message to the user advising them to purchase a new pack of consumables. In some examples the device can also be adapted to handle a user who wishes to use multiple packets of different consumables, with the choice to swap them around. In those examples the device can store the information from each pack, and every time the user informs the device of what consumable is being inserted in the chamber, the device can adjust the settings through the control module to be adapted to the consumable inserted in the chamber.

Once the tobacco body 3 is ejected from the heating chamber 10, the ejector 2 can be retracted to back to the non-actuated position shown in FIG. 2A. This can be achieved by the user manually advancing the ejector 2 back in to the device, or by a retracting mechanism utilising spring-loaded switches. In the retracted position the heating chamber is ready again to receive another tobacco body 3 to be used.

Figure 3A:
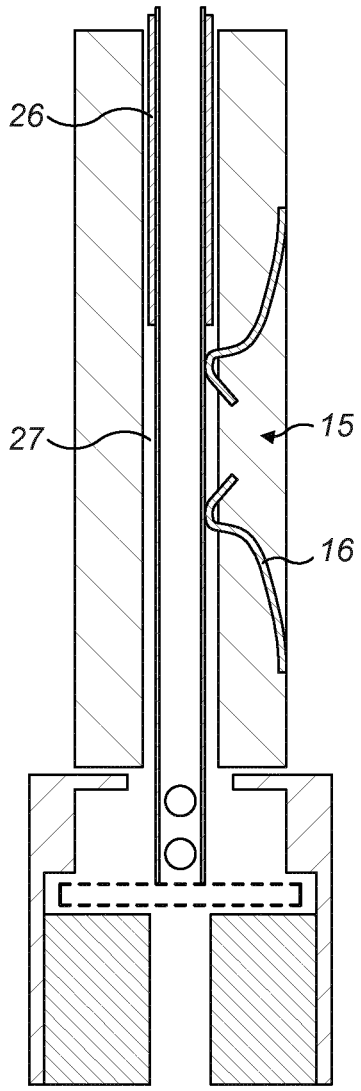
FIG. 3A schematically illustrates a close-up view of an example vapour generating device in a first assembled configuration.
Figure 3B:
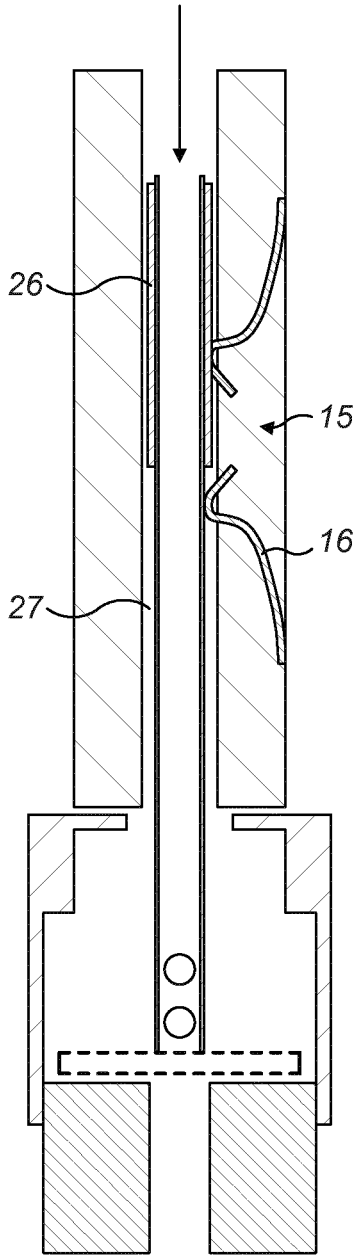
FIG. 3B schematically illustrates a close-up view of an example vapour generating device in a second assembled configuration.

In some examples, the heating assembly 1 comprises a detector 15, arranged to detect actuation of the ejector 2. One such example is generally illustrated in FIGS. 3A and 3B. While the detector 15 can take one of a number of forms, in this example, the detector 15 comprises a simple electrical switch.

The detector 15 comprises an electrical circuit 16 having a break. The break in the circuit 16 acts as a switch, which is closed when an electrical conductor is placed in contact across the break. Although for illustrative purposes the example here is described with one circuit having one break, in practice the detector 15 may generally comprise one or more circuits having one or more breaks.

The ejector 2 is provided with an insulating portion 26 and a conductive portion 27 on the tubular portion 20. In this example, the tubular portion 20 is formed of a metallic, conducting material: the conductive portion 27 comprises a bare section of the metallic tubular portion 20 and the insulating portion 26 comprises a section having an electrical insulation coating. Alternatively, in other examples, the tubular portion 20 is formed of non-conducting materials such as plastic, in which case the conductive portion 27 comprises a section having an electrically conductive coating and the insulating portion 26 comprises a bare section of the plastic tubular portion 20.

In some examples, the tubular portion 20 can have a plurality of conductive portions 27 and insulating portions 26. Similarly, the detector circuit 16 can have a plurality of breaks. The plurality of conductive 27 and insulating 26 portions can be arranged so as to provide a particular switching characteristic when operating with the electrical circuit 16 of the detector 15.

In FIG. 3A, the ejector 2 is illustrated in the retracted position and a body 3 of tobacco material occupies the heating chamber 10. The conductive portion 27 is positioned across the break in the circuit 16 so as to complete the circuit. In this position, the electrical contacts of the circuit 16 are closed and the ejector 2 is detected by the detector 15.

When the ejector 2 is actuated, causing the ejector 2 to advance into the heating chamber 10 and eject the tobacco body 3 as illustrated in FIG. 3B, the insulating portion 26 advances to come into contact with one or more of the electrical contacts of the detector circuit 16. In this position, the electrical contacts of the circuit 16 are open and the ejector 2 is no longer detected by the detector 15. Due to this change in the detector circuit connection, the detector 15 is able to detect that the ejector 2 has been actuated.

The actuation of the ejector 2 can be used to activate certain functions within the device. For example, when the detector 15 detects actuation of the ejector 2, the detector 15 can be arranged to send a signal to other components, such as a control module, in the device.

In some examples, the device comprises a puff counter. The puff counter is arranged to detect and count when a user inhales, or takes a puff of, the vapour generated in the device. The information from the puff counter can be displayed to the user via an external display or indicator, so that the user can keep track of the number of puffs taken with the current consumable body 3 of tobacco. When the body 3 is depleted and the user wishes to replace the contents of the heating chamber 10, the puff counter can be reset. A control module in the device can be arranged to reset the puff counter whenever the detector 15 detects actuation of the ejector 2. Alternatively, the detector 15 can be directly connected to the puff counter to cause the puff counter to reset when ejection is detected.

Figure 4:
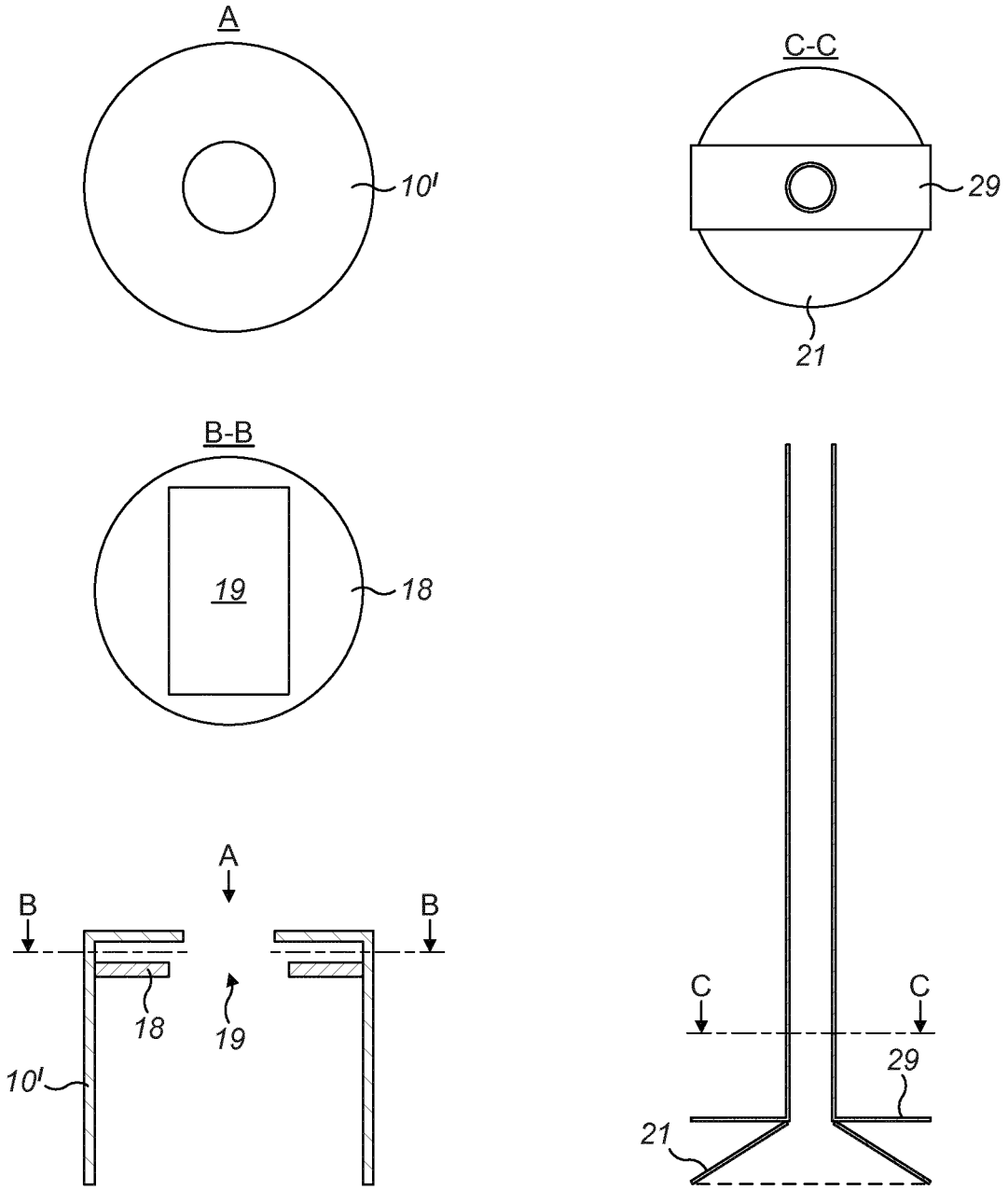
FIG. 4 schematically illustrates components of an example vapour generating device in a generally unassembled configuration FIG. 5A schematically illustrates a close-up view of an example vapour generating device in a first assembled configuration FIG. 5B schematically illustrates a close-up view of an example vapour generating device in a second assembled configuration FIG. 5C schematically illustrates a close-up view of an example vapour generating device in a third assembled configuration.

In some examples, the heating chamber 10 is removable from the heating assembly 1, and therefore from the device. In such a case, the ejector 2 can be configured to eject the heating chamber 10 as well as the tobacco body 3. FIG. 4 illustrates how the ejector 2' and the heating chamber 10' can be adapted to allow such an arrangement.

In addition to the features described with respect to previous examples, the ejector 2' further comprises a secondary protrusion 29. The secondary protrusion 29 is positioned on the tubular portion 20 at a position less distal than the protrusion 21. While the protrusion 21 is typically of the same cross-sectional profile as the heating chamber 10, the secondary protrusion 29 has a cross-sectional profile which is different from the heating chamber profile. The protrusion 29 can take any shape as long as the shape is not a circle. Preferably the shape of the protrusion 29 is a shape having low rotational symmetry. In this example, the secondary protrusion 29 comprises a rectangular cross section.

Similarly, in addition to the features described with respect to the previous examples, the heating chamber 10' further comprises a restrictor 18. The restrictor 18 comprises an opening 19 having a shape that is complimentary to the profile of the secondary protrusion 29. By 'complimentary' we intend to mean that the opening 19 is of a shape which allows an object having the shape of the secondary protrusion 29 to pass through freely. This can be achieved for example by having the opening 19 be the same shape and size as the secondary protrusion 29, or the same general shape but larger in size than the secondary protrusion 29.

In use, the ejector 2' is provided in the device in a similar manner to the examples described above. In the retracted position, the heating chamber 10 is occupied by the tobacco body 3 and the ejector 2' is arranged such that the protrusion 21 is at one proximal end of the heating chamber 10. The restrictor 18 is provided in the chamber 10' such that, when the ejector 2' is in the retracted position (as shown in FIG. 5A), the secondary protrusion 29 is positioned between a top wall of the heating chamber 10' and the restrictor 18. In the configuration shown in FIG. 5A, the ejector 2' has been rotated about its longitudinal axis to a first rotational position, in which the secondary protrusion 29 and the opening 19 of the restrictor 18 are misaligned. In such a position, the restrictor 18 provides a small resistive force to prevent the ejector 2' from passing through the opening 19.

When the ejector 2' is actuated in this first position, the contact surface 22 of the protrusion 21 engages a top surface of the restrictor 18 and exerts a force on the restrictor 18. As the restrictor 18 is provided with and is attached to the heating chamber 10', the force applied by the ejector 2' accelerates the heating chamber 10' to displace the heating chamber 10' from the heating assembly 1. As shown in FIG. 5B, the heating chamber 10' can therefore be removed from the heating assembly 1. It can be seen that, due to the restrictor 18 preventing the protrusion 21 from advancing into the heating chamber 10, no force is applied directly to the tobacco body 3 from the protrusion 21.

Referring back to FIG. 5A, the ejector 2' can be rotated about its longitudinal axis to change the orientation or position of the secondary protrusion 29. In this example, the ejector 2' can be rotated about its longitudinal axis to a second rotational position, in which the secondary protrusion 29 and the opening 19 of the restrictor 18 are aligned. In such a position, the secondary protrusion 29 is able to pass freely through the opening 19 in the restrictor 18.

Figure 5C:
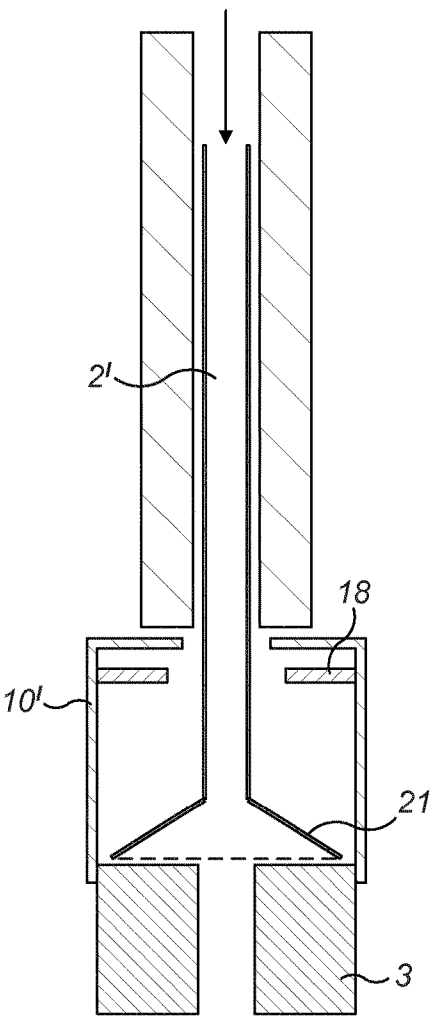
Figure 5B:
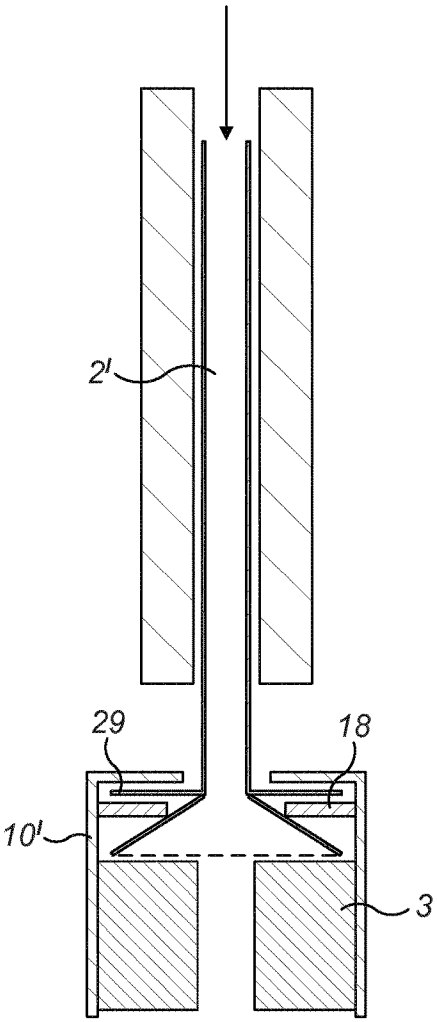
Figure 5A:
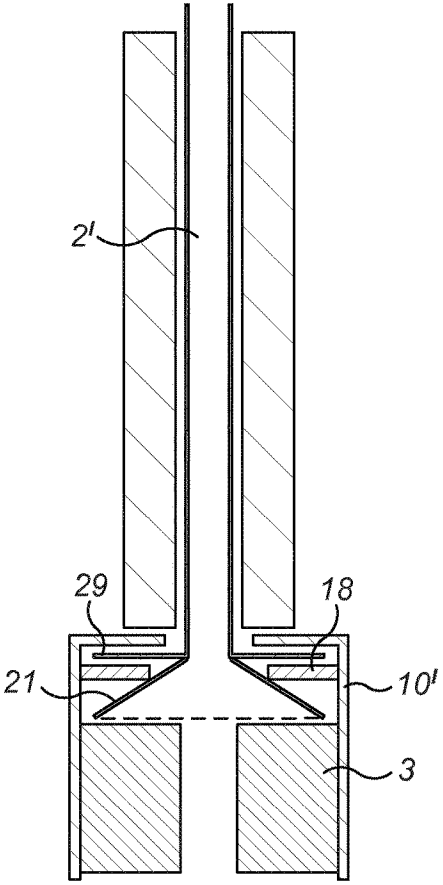

As shown in FIG. 5C, when the ejector 2' is actuated in this second position, the secondary protrusion passes freely through the opening 19 and the protrusion 21 advances into the heating chamber to push the body 3 of tobacco material. The contact surface 22 applies a force to accelerate the body 3 out of the heating chamber, as described with respect to FIGS. 2A and 2B, for example.

In this way, it is possible to provide an ejector with the capability to eject the heating chamber and the tobacco material out of the vapour generating device. The user can select which of the two is to be ejected by changing the position or orientation of the ejector with respect to the heating assembly.

Figure 6B:
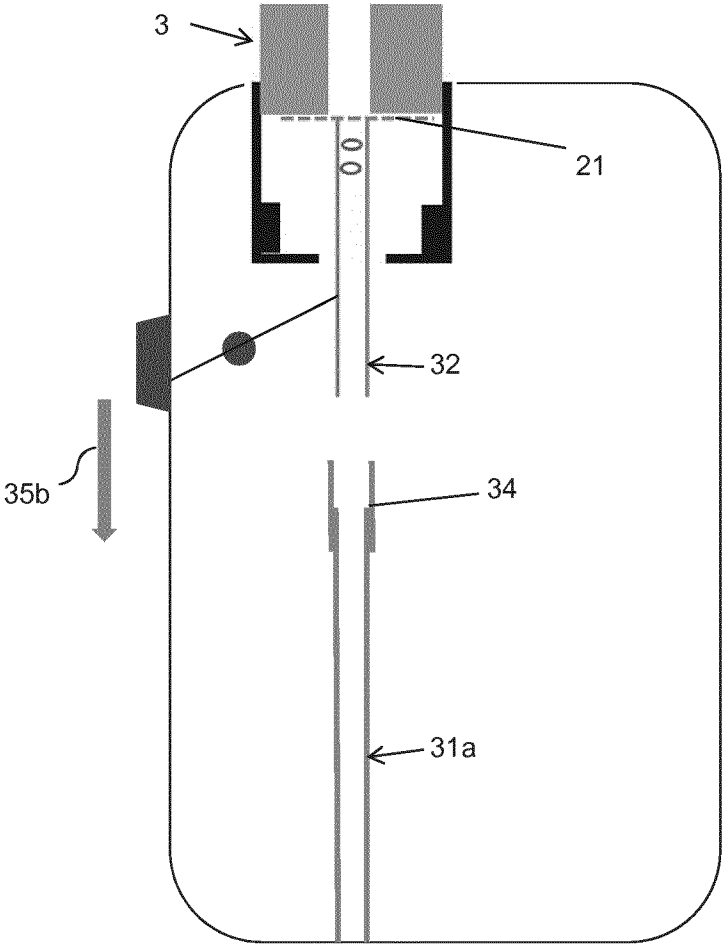
FIG. 6B schematically illustrates an example vapour generating device in a second assembled configuration.
Figure 6A:
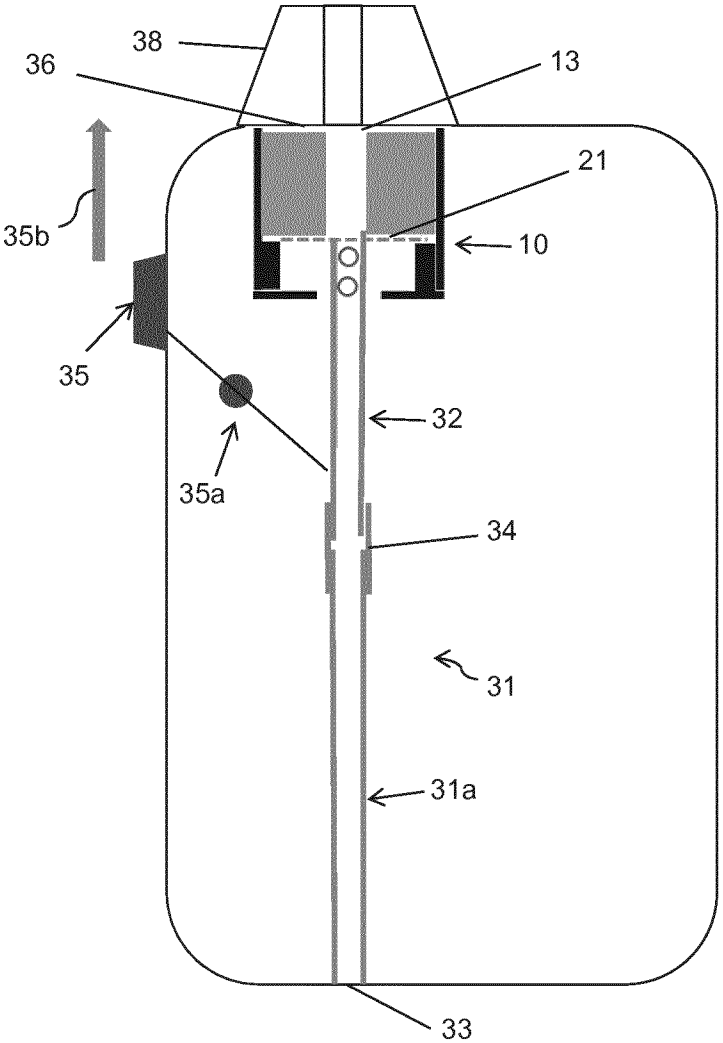
FIG. 6A schematically illustrates an example vapour generating device in a first assembled configuration.

Some of the examples described above illustrate how a vapour generating device can be provided with an ejector which allows vapour flow from the chamber to the user and which is capable of ejecting the vapour or aerosol generating substance contained therein. In some examples, the ejector can be arranged to allow flow of ambient air through an air inlet to the heating chamber. One such example is illustrated in FIGS. 6A and 6B.

Similar to the examples described above, the vapour generating device comprises a heating chamber 10 arranged to hold, and heat via operation of a heater 11, a body 3 of aerosol generating material, typically a tobacco foam. FIG. 6A illustrates the device in a vapour generating configuration.

The device comprises an air inlet 33, through which ambient air can enter the device, and an air outlet 36 through which vapour generated in the chamber 10 can exit the device. The inlet 33 and outlet 36 are generally in communication through a vapour passage 31. In this example, the inlet 33 is connected to the heating chamber 10 via the vapour passage 31, and the heating chamber 10 is connected to the outlet 36. As will become apparent from the description below, the vapour passage 31 includes a main body 31*a*, ejector 32 and the chamber 10. Whilst the term 'vapour passage' is used to refer generally to the fluid channel between the inlet and outlet, it will be understood that the passage may carry any appropriate fluid including vapour. For example, at least a portion of the vapour passage 31 may act as an air passage, to carry air entering the device from the inlet 33 to the chamber 10.

In use, ambient air enters the device through the air inlet 33 and flows into the heating chamber 10 via the vapour passage 31. The air, together with vapour generated in the chamber 10, is communicated through the outlet 36 out of the device and to the user. In this way, the inlet 33, vapour passage 31, chamber 10 and outlet 36 allow the flow of air through the device to deliver vapour to the user. The air flow may be accelerated through this air flow route by negative pressure at the outlet 36, generated for example by the action of a user sucking or inhaling at or near the outlet 36. The device may be provided, as shown in the example of FIG. 6A, with a mouthpiece 38 to allow a user to easily inhale the vapour generated from the device. The mouthpiece 38 is in direct fluid communication with the outlet 36, and is provided with at least one bore through which vapour can flow, in use, from the outlet 36 to the user's mouth. The mouthpiece 38 is typically secured to the rest of the device via a removable connection, such as a screw thread connection or a clip fit connection.

As in the other examples, the vapour generating device comprises an ejector 32, operable to allow a user to selectively eject the tobacco body 3 from the chamber 10. In this example, the chamber 10 comprises an opening 13 which is at the mouthpiece end of the device. In other words, the opening 13 is in direct communication with the outlet 36. When a user operates the ejector 32 to eject the body 3, the body 3 is accelerated towards the outlet 36 and is ejected through the mouthpiece end. In other words, the movement of the ejector 32 and the resulting motion of the body 3 are in the same direction as the direction of vapour flow through the device.

The ejector 32 forms part of the vapour passage 31. By this we mean that the ejector 32 is in direct fluid communication within the vapour passage 31 so as to allow the channeled passage of fluid from the air inlet 33 to the heating chamber 10. This can be achieved in a number of ways. For example, a main body 31*a* of the vapour passage 31 may comprise a hollow tube or pipe which allows fluid, such as air or vapour, to flow from one extremal end of the passage to the other. In this regard the passage 31 acts a channel for the fluid. The ejector 32 typically comprises a hollow tubular portion, as described in relation to the other examples above. The hollow tubular portion of the ejector 32 can be positioned and aligned within the vapour passage 31 so as to be in fluid communication with the main body 31*a* of the vapour passage. Typically, this means the hollow tubular portion of the ejector 32 is aligned co-axially with respect to the main body 31*a* of the passage. The ejector 32 therefore forms part of the fluid channel such that, in use, air enters from the inlet 33 to the vapour passage 31, through the hollow centre of the tubular portion of the ejector 32 and into the chamber 10.

The diameter of the hollow tubular portion of the ejector 32 may be equal to the diameter of the main body 31*a* of the vapour passage 31. Alternatively, the hollow tubular portion of the ejector 32 may have a diameter that is greater than the diameter of the main body 31*a* of the passage. In such a case, at least a portion of the ejector 31 may overlap a portion of the main body 31*a* when the device is in a vapour generating configuration. Alternatively, the hollow tubular portion of the ejector 32 may have a diameter may have a diameter that is smaller than the diameter of the main body 31*a*. In such a case, at least a portion of the ejector 31 may be circumscribed by a portion of the main body 31*a*.

In some examples, the vapour passage 31 may comprise a gasket 34 to ensure a tight seal for fluid communication. The gasket 34 shown in FIG. 6A provides a seal between corresponding ends of the main body 31*a* of the vapour passage and the hollow tubular portion of the ejector 32. A gasket 34 may be employed regardless of the diameters of the hollow tubular portion and of the main body of the vapour passage 31*a*. That is, a gasket 34 may be used to join overlapping or non-overlapping ends of the ejector 32 and main body 31*a* of the vapour passage.

The ejector 32 can be actuated, in a similar manner to the ejector of other examples described above, to eject the tobacco body 3 from the heating chamber 10. For example, the ejector 32 can be advanced toward the opening 13 of the chamber so as to push, via the protrusion 21 of the ejector, the body 3 out of the opening 13. In some examples, the mouthpiece 38 is first removed to allow ejection of the body 3. In some examples, actuation of the ejector 32 causes the mouthpiece 38 to become displaced or removed. In other examples, the device can perform ejection whilst maintaining the mouthpiece 38 on the device. FIG. 6B illustrates the device in an ejecting configuration.

As described above with reference to the various other examples, the ejector 32 can be actuated in one of a number of different ways. One way in which the ejector 32 can be operated is by use of a switch 35 positioned on the surface of the device. The switch 35 in this example is a sliding switch comprising a lever mechanism. The lever mechanism comprises a slide handle connected to a lever through a pivot 35*a*, the lever being connected to the ejector 32 such that movement of the slide handle causes movement of the ejector 32. The slide handle is positioned on the surface of the device such that a user can easily access and actuate the switch with his hands. Specifically, the handle is on a side surface of the device. Typically, such switch mechanisms allow the user to easily effect reversible movement of the ejector 32 in a longitudinal direction so as to advance or retract the protrusion 21 within the heating chamber 10. In FIGS. 6A and 6B, arrows 35*b* indicate the direction of actuation of the sliding switch resulting in the configuration of each respective figure. The sliding lever mechanism may comprise a spring or other biasing mechanisms to aid movement of the switch 35. In other examples, a slide switch does not include a pivot and utilises a simple connection between a portion of the ejector 32 and the external lever handle. As with the switches described with respect to the other examples above, the switch can also comprise an electro-mechanical system, such as a motor.

In the ejecting configuration, illustrated in FIG. 6B, the ejector 32 is advanced towards the opening 13 of the chamber 10 and the tobacco body 3 is partially or fully ejected from the chamber 10. In such a configuration, the ejector 32 may be temporarily detached from the main body 31*a* of the vapour passage, due to the advancement of the ejector 32 into the chamber 10 and the consequent movement of the tubular portion of the ejector 32 away from the main body 31*a*.

In some examples, the tubular portion of the ejector 32 can be arranged such that, even in the ejecting configuration the fluid communication between the main body 31*a* and the ejector 32 is maintained. This can be achieved for example by having a tubular portion which is long enough so that a significant portion of the tubular portion 32 overlaps with a portion of the main body 31*a* of the vapour passage. In this way, a vapour tight seal within the vapour passage 31 can be maintained in both the retracted and actuated configurations of the ejector 32.

By having a chamber 10 and ejector 32 arranged to allow ejection of the tobacco body 3 through an outlet 36 side of the device, it is possible to position the air inlet 33 and passage 31 at any desired position within the device. Furthermore, such an arrangement ensures that the movement of the tobacco body 3, once depleted and ejected thereafter, is in the same direction as the flow of air and vapour through the device.

Figure 7B:
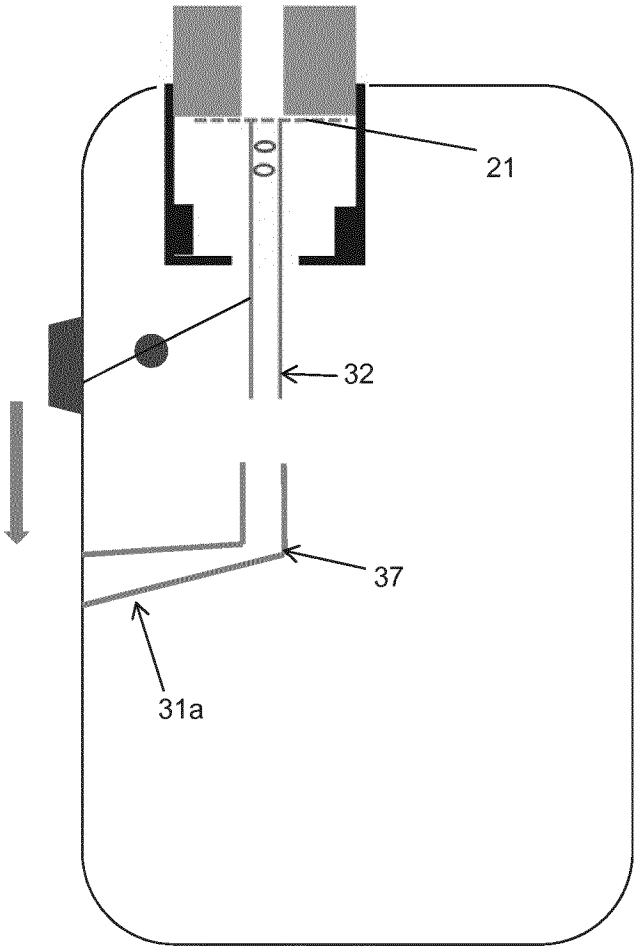
FIG. 7B schematically illustrates an example vapour generating device in a second assembled configuration.
Figure 7A:
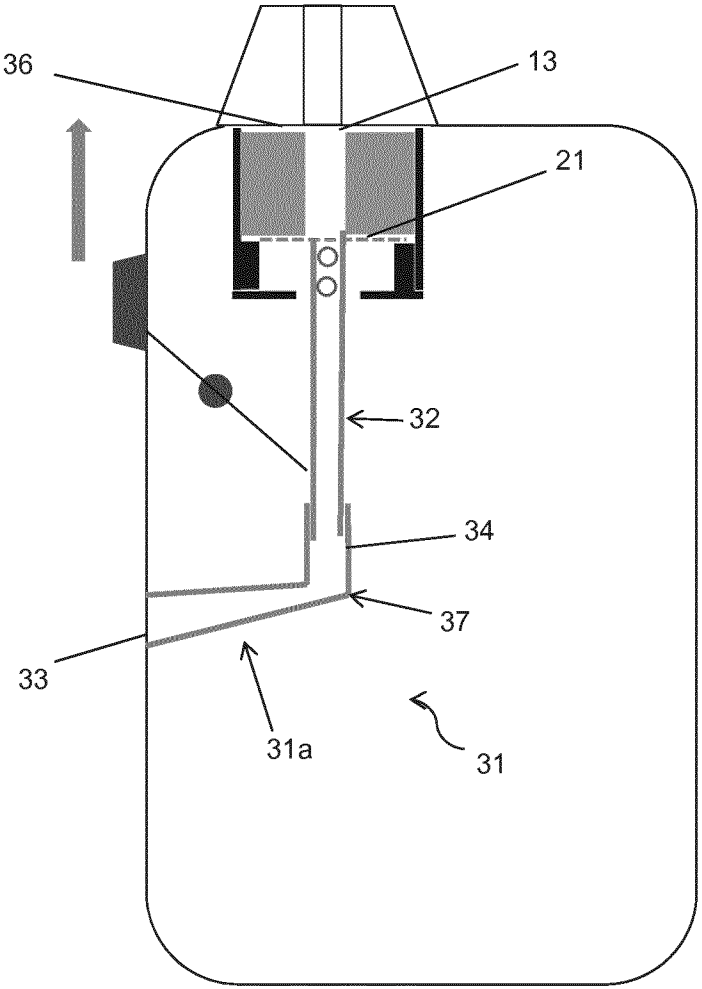
FIG. 7A schematically illustrates an example vapour generating device in a first assembled configuration.

As an example of the flexibility in arrangement of components in the device, FIGS. 7A and 7B illustrate a device in which the air inlet 33 is located at a side of the device, and the inlet passage 31 comprises a bend 37. In examples of the invention the passage 31 may be provided with one or a plurality of such bends 37 to provide a specific air flow path through the device. Such an arrangement allows, for example, a desired configuration of components within the device.

As will be appreciated from the above, the present invention, by providing the functionalities of an ejector capable of providing selective ejection of the aerosol generating material from the heating chamber, enables the provision of a vapour generating device in which the material can be placed in good thermal contact with the heater so as to provide significantly improved heating performance. The ability to selectively eject the heating chamber is a further useful advantage of the ejector. The ejector is also capable of providing an effective vapour passage to ensure good fluid communication of the vapour generated by the device to the user. An electronic vapour generating device with improved heating performance and ejection capabilities is achieved by the invention, while still providing excellent heating and vapour provision functionalities of such a device.

The invention claimed is:

1. A heating assembly for a vapour generating device, the heating assembly comprising:

a heating chamber arranged to hold an aerosol generating medium;

a heater arranged, in use, to provide heating to the heating chamber;

an ejector arranged to controllably eject, in use, the aerosol generating medium from the heating chamber; and a detector arranged, in use, to detect actuation of the ejector, wherein the ejector comprises one or more electrical contacts and the detector is arranged, in use, to detect actuation of the ejector based on the position of the one or more electrical contacts.

2. The heating assembly according to claim 1, wherein the detector is arranged to send a signal to a control module in response to the detection of actuation of the ejector.

3. A vapour generating device comprising the heating assembly according to claim 1; and a vapour passage to carry vapour generated in the heating chamber from the heating chamber to an air outlet, wherein at least a portion of the vapour passage is formed by the ejector.

4. A vapour generating device comprising the heating assembly according to claim 1, and a control module; wherein the detector is arranged to send a signal to the control module in response to the detection of actuation of the ejector, and wherein the control module is arranged to reset a puff counter in the vapour generating device in response to the detection of actuation of the ejector.

5. The heating assembly according to claim 1, wherein the ejector comprises a tubular portion, and the one or more electrical contacts are positioned on the tubular portion of the ejector.

6. The heating assembly according to claim 5, wherein the chamber comprises an opening and the ejector is arranged to push, in use, the aerosol generating medium toward the opening of the chamber.

7. A vapour generating device comprising the heating assembly according to claim 1; and an air passage to carry air from an air inlet to the heating chamber, wherein at least a portion of the air passage is formed by the ejector.

8. The vapour generating device according to claim 7, further comprising a vapour passage to carry vapour generated in the heating chamber from the heating chamber to an air outlet, wherein at least a portion of the vapour passage is formed by the ejector.

9. The vapour generating device according to claim 7, wherein the air passage comprises a gasket and the ejector is sealed within the passage by the gasket when the device is operable to generate vapour.

10. The vapour generating device according to claim 7, wherein the ejector is arranged to eject the aerosol generating medium toward the outlet of the device.

11. The vapour generating device according to claim 7, wherein actuation of the ejector causes the ejector to move in the direction of air flow through the device or in a direction opposite to the direction of airflow through the device.

12. The vapour generating device according to claim 7, further comprising a switch operable to actuate the ejector.

13. The vapour generating device according to claim 12, wherein the switch comprises a sliding lever mechanism comprising a slide handle connected to a lever through a pivot, the lever being connected to the ejector such that movement of the slide handle causes movement of the ejector.

14. A heating assembly for a vapour generating device, the heating assembly comprising:

a heating chamber arranged to hold an aerosol generating medium;

a heater arranged, in use, to provide heating to the heating chamber; and an ejector arranged to controllably eject, in use, the aerosol generating medium from the heating chamber;

an inlet; and a passage in fluid communication with the inlet and the heating chamber, wherein at least a portion of the passage is formed by the ejector, wherein the ejector comprises a protrusion, configured, in use, to be directly adjacent an inner wall of the heating chamber.

* * * * *